United States Patent [19]

Wen

[11] Patent Number: 5,025,817

[45] Date of Patent: Jun. 25, 1991

[54] STRUCTURE OF SPHERICAL VANITY CASE

[76] Inventor: Steven Wen, 3 Fl., No. 73-5, Chi Nan Rd., Sec. 2, Taipei, Taiwan, R.O.C.

[21] Appl. No.: 550,576

[22] Filed: Jul. 10, 1990

[51] Int. Cl.[5] ..... A45D 33/22

[52] U.S. Cl. ..... 132/296; 132/294; 132/295; 132/297; 132/304; 132/305; 206/581; 206/823

[58] Field of Search ..... 132/294, 295, 296, 297, 132/300, 301, 304, 305, 314, 315, 316, 317, 318; 206/581, 823, 260, 345

[56] References Cited

U.S. PATENT DOCUMENTS

| | | | |
|---|---|---|---|
| 1,455,432 | 5/1923 | Dodson | 132/297 X |
| 1,503,378 | 7/1924 | Reid | 132/296 |
| 1,525,665 | 2/1925 | Slover et al. | 132/297 X |
| 1,670,315 | 5/1928 | Reutter | 132/305 |
| 2,066,226 | 12/1936 | Reilly | 132/301 |
| 2,248,689 | 7/1941 | Porter | 132/297 |
| 2,396,932 | 3/1946 | Slaton et al. | 132/314 |
| 2,471,441 | 5/1949 | Moore | 132/314 |
| 3,132,652 | 5/1964 | Gazdik | 132/297 |
| 3,559,854 | 2/1971 | Loveland | 132/294 X |
| 3,860,016 | 1/1975 | Mackiernan | 132/294 |
| 4,679,692 | 7/1987 | Davey | 206/823 X |
| 4,685,558 | 8/1987 | Filiz et al. | 206/581 X |
| 4,777,969 | 10/1988 | Holloway | 206/823 X |
| 4,936,324 | 6/1990 | Chen | 132/294 |
| 4,944,402 | 7/1990 | Wu | 206/581 |

*Primary Examiner*—John J. Wilson
*Assistant Examiner*—Jeffrey A. Smith
*Attorney, Agent, or Firm*—Fleit, Jacobson, Cohn, Price, Holman & Stern

[57] ABSTRACT

Disclosed is a spherical vanity case, which is formed of an upper cover, an intermediate unit and a bottom unit. The upper cover has a mirror pivoted thereto to define with the intermediate unit a receiving space for keeping small toiletries. The intermediate unit has a center hole into which a hollow shaft upstanding from the bottom unit is fastened, a plurality of compartments on its top surface for holding dusting powder and rouge cake, and a plurality of bottom slots radially arranged around a circle respectively for receiving a powder make-up case each. Each powder make-up case has a bottom projection respectively movably fastened in a corresponding groove on the top surface of the bottom unit such that relative rotation of the intermediate unit against the bottom unit drives the powder make-up cases to slide in or out of the bottom slots. The hollow shaft of the bottom unit defines therein a space for carrying a lipstick.

3 Claims, 6 Drawing Sheets

STRUCTURE OF SPHERICAL VANITY CASE

BACKGROUND OF THE INVENTION

The present invention is related to vanity cases and more particularly to a spherical vanity case fitted for carrying a variety of cosmetics.

Conventional vanity cases are generally flat-shaped. According to conventional concept, any change in design does not make a case free from vulgarity.

The present invention is to design a compact vanity case in spherical shape with a variety of compartments for carrying a variety of cosmetics.

SUMMARY OF THE INVENTION

The present invention is to provide a vanity case which is formed of an upper cover, an intermediate unit and a bottom unit. The upper cover has a mirror pivoted thereto to define with the intermediate unit a receiving space for keeping small toiletries. The intermediate unit has a center hole into which a hollow shaft upstanding from the bottom unit is fastened, a plurality of compartments on its top surface for holding dusting powder and rouge cake, and a plurality of bottom slot radially arranged around a circle respectively for receiving a powder make-up case each. Each powder make-up case has a bottom projection respectively movably fastened in a corresponding groove on the top surface of the bottom unit such that relative rotation of the intermediate unit against the bottom unit drives the powder make-up cases to slide in or out of the bottom slots. The hollow shaft of the bottom unit defines a space therein for carrying a lipstick.

According to one aspect of the afore-said structure, the powder make-up cases are respectively designed in a substantially rectangular shape having each two opposite sides made in parallel with each other and the intermediate unit has a plurality of slots radially made on its bottom and designed in size for receiving the powder make-up cases one each permitting the bottom projection of each of the powder make-up cases to movably correspondingly fasten in one of the grooves on the bottom unit so that the powder make-up cases can be respectively forced to radially slide in or out of the slots during the relative rotation of the intermediate unit against the bottom unit.

According to another aspect of the present invention, the hollow shaft comprises a circular groove on its inner wall surface having a rubber ring fixedly fastened therein, which rubber ring has an inner diameter slightly smaller than the inner diameter of the hollow shaft so that a lipstick can be inserted in the hollow shaft from the bottom to be firmly retained therein by the rubber ring.

BRIEF DESCRIPTION OF THE DRAWINGS

The present invention will now be described by way of example, with reference to the annexed drawings, in which.

DETAILED DESCRIPTION OF THE PREFERRED EMBODIMENT

Figure 1:
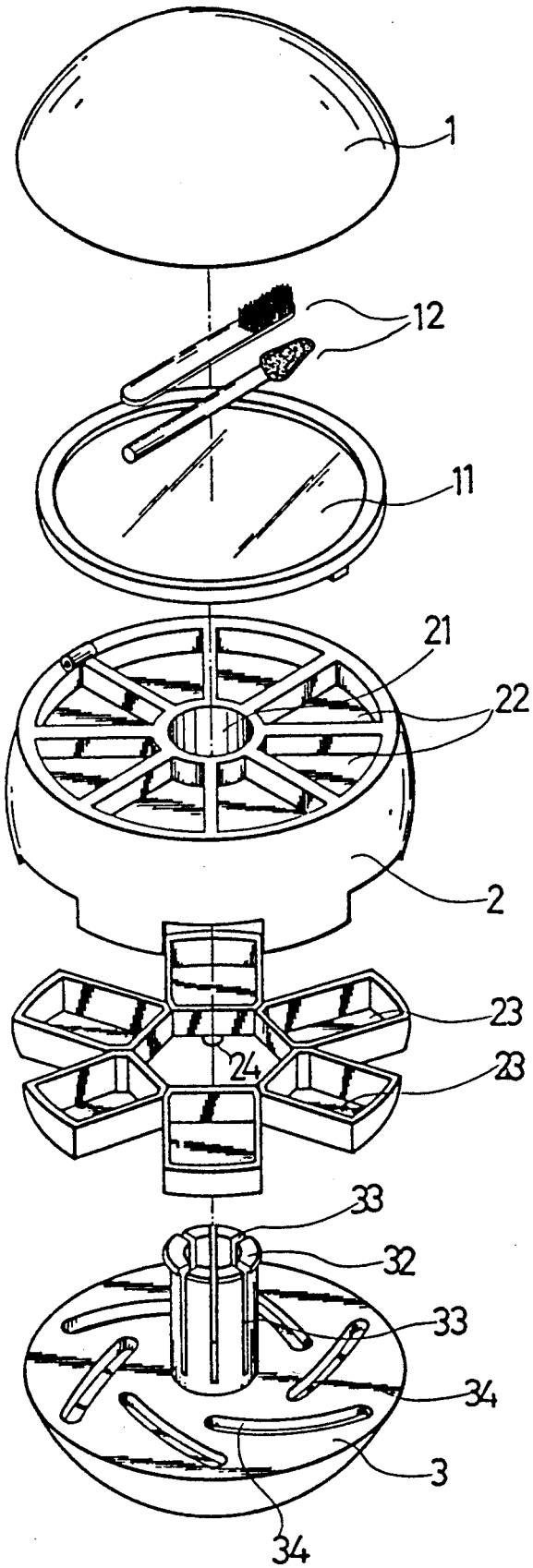
FIG. 1 is a perspective fragmentary view of a vanity case according to the present invention.
Figure 2:
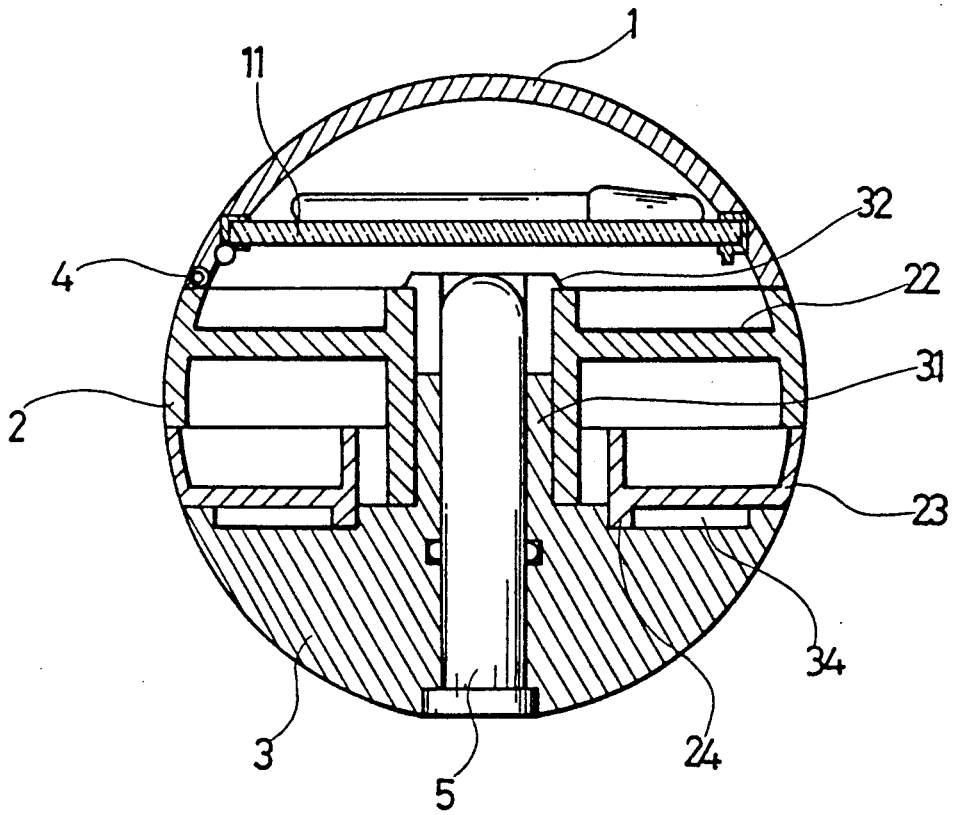
FIG. 2 is a sectional assembly view thereof.
Figure 3:
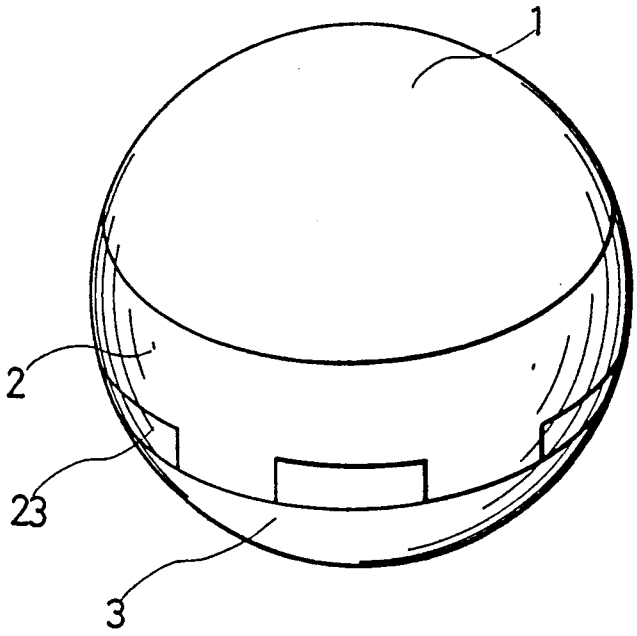
FIG. 3 is a perspective assembly view thereof, in which the case is closed.

Turning now to the annexed drawings in great detail and referring first to FIGS. 1 and 2, therein illustrated is a vanity case embodying the present invention and generally comprised of an upper cover 1, an intermediate unit 2 and a bottom unit 3. A mirror 11 is pivoted to the upper cover 1 and defines therewith a receiving space for keeping eyebrow brush and eyelash pencil 12. The intermediate unit 2 comprises a center hole 21 through its axis, a plurality of compartments 22 on the top for keeping powder make-up, a plurality of powder make-up cases 23 at the bottom and radially arranged around a circle to slide in and out thereof, which powder make-up cases 23 comprise each a bottom projection 24 extending downward from its bottom. The bottom unit 3 comprises a hollow shaft 31 upstanding therefrom at the center for inserting in the center hole 21 of the intermediate unit 2, and a plurality of grooves 34 spirally radially made on the top surface thereof, in which the hollow shaft 31 comprises a top flange 32 having a plurality of notches vertically made thereon. There is a pivot 4 internally connected between the upper cover 1 and the intermediate unit 2 at one side, to pivotably secure the upper cover 1 to the intermediate unit 2. The bottom unit 3 is attached to the intermediate unit 2 at the bottom, with its hollow shaft 31 inserted through the center hole 21 of the intermediate unit 2 permitting the top flange 32 to stop at the topmost edge of the center hole 21. After assembly (as illustrated in FIG. 3), the projecting ends 24 of the powder make-up cases 23 of the intermediate unit 2 are respectively inserted in the grooves 34 on the top of the bottom unit 3. Therefore, when the intermediate unit 2 and the bottom unit 3 are relatively rotated, the powder make-up cases 23 are simultaneously radially moved in or out (see FIGS. 3 and 4). Further, a lipstick 5 may be received inside the hollow shaft 31.

Referring to FIGS. 1 and 2 again, because of the design of the notches 33 on the top flange 32 of the hollow shaft 31 of the bottom unit 3 the outer diameter of the hollow shaft 31 can be squeezed inward to pass through the center hole 21 when it is inserted therein. As soon as the top flange 32 of the hollow shaft 31 protrude beyond the topmost edge of the center hole 21, the elastic resilience of the material property of the top flange 32 immediately forces itself to firmly retain at the top of the center hole 21 permitting the bottom unit 3 and the intermediate unit 2 to relatively rotate against each other but prohibiting the bottom unit 3 and the intermediate unit 2 from breaking away.

Figure 4:
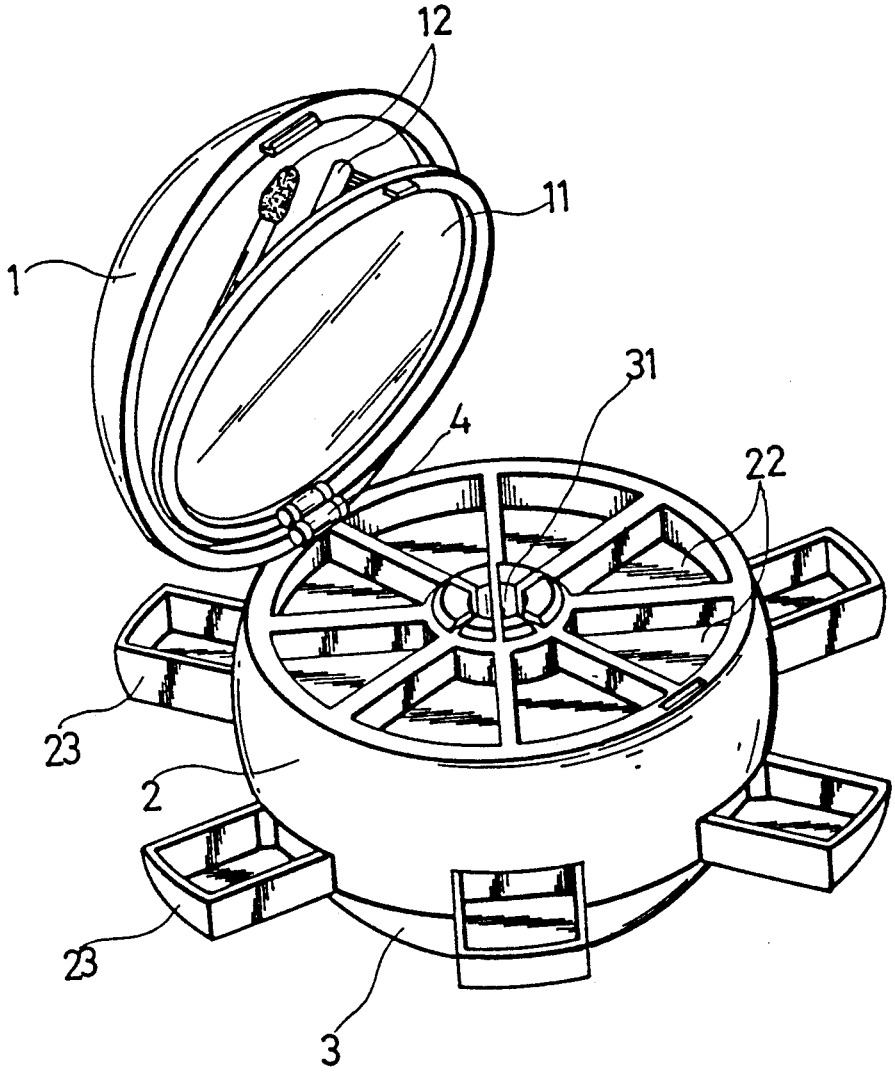
FIG. 4 is a perspective assembly view thereof, in which the case is opened.
Figure 5:
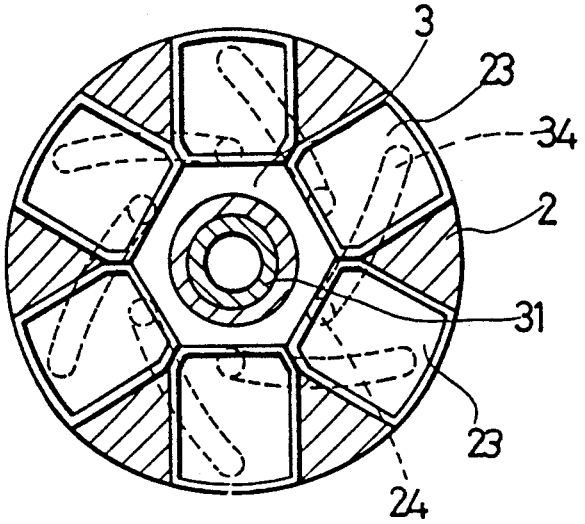
FIG. 5 is a schematic drawing illustrating an operation to draw the powder make-up cases back inside the intermediate unit.
Figure 6:
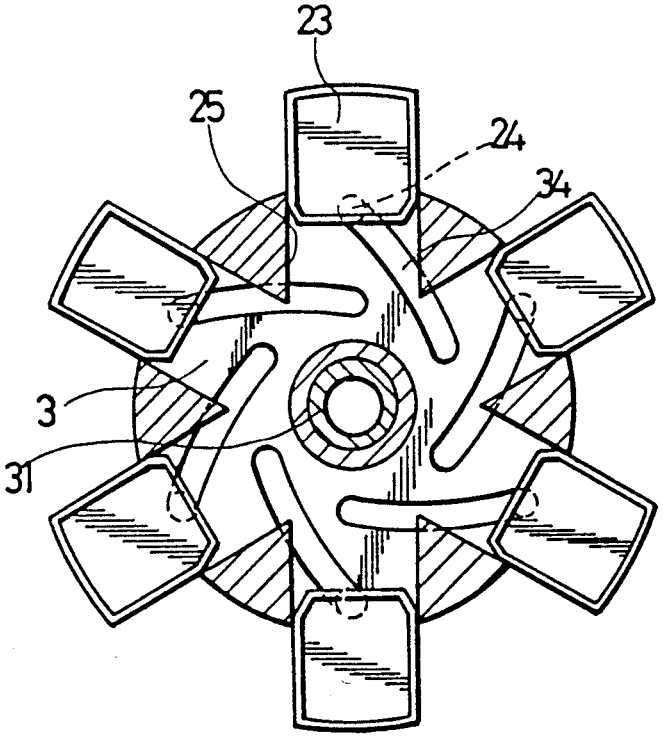
FIG. 6 is a schematic drawing illustrating an operation to push the powder make-up cases to protrude beyond the intermediate unit.

Referring to FIGS. 5 and 6, the powder make-up cases 23 are respectively designed in a substantially rectangular shape having each two opposite sides made in parallel with each other. There are a plurality of slots 25 radially made on the bottom of the intermediate unit 2, which slots 25 are designed in size according to the powder make-up cases 23 so that each powder make-up case 23 can be received in each slot 25. As described above, the powder make-up cases 23 have each a bottom projection 24 movably fastened in one of the grooves 34 on the top surface of the bottom unit 1. Therefore, when the intermediate unit 2 and the bottom unit 3 are relatively rotated against each other, the powder make-up cases 23 are respectively forced to radially move outward or inward along the grooves so as to respectively slide in or out of the slots 25 (as shown in FIGS. 3 and 4).

Figure 7:
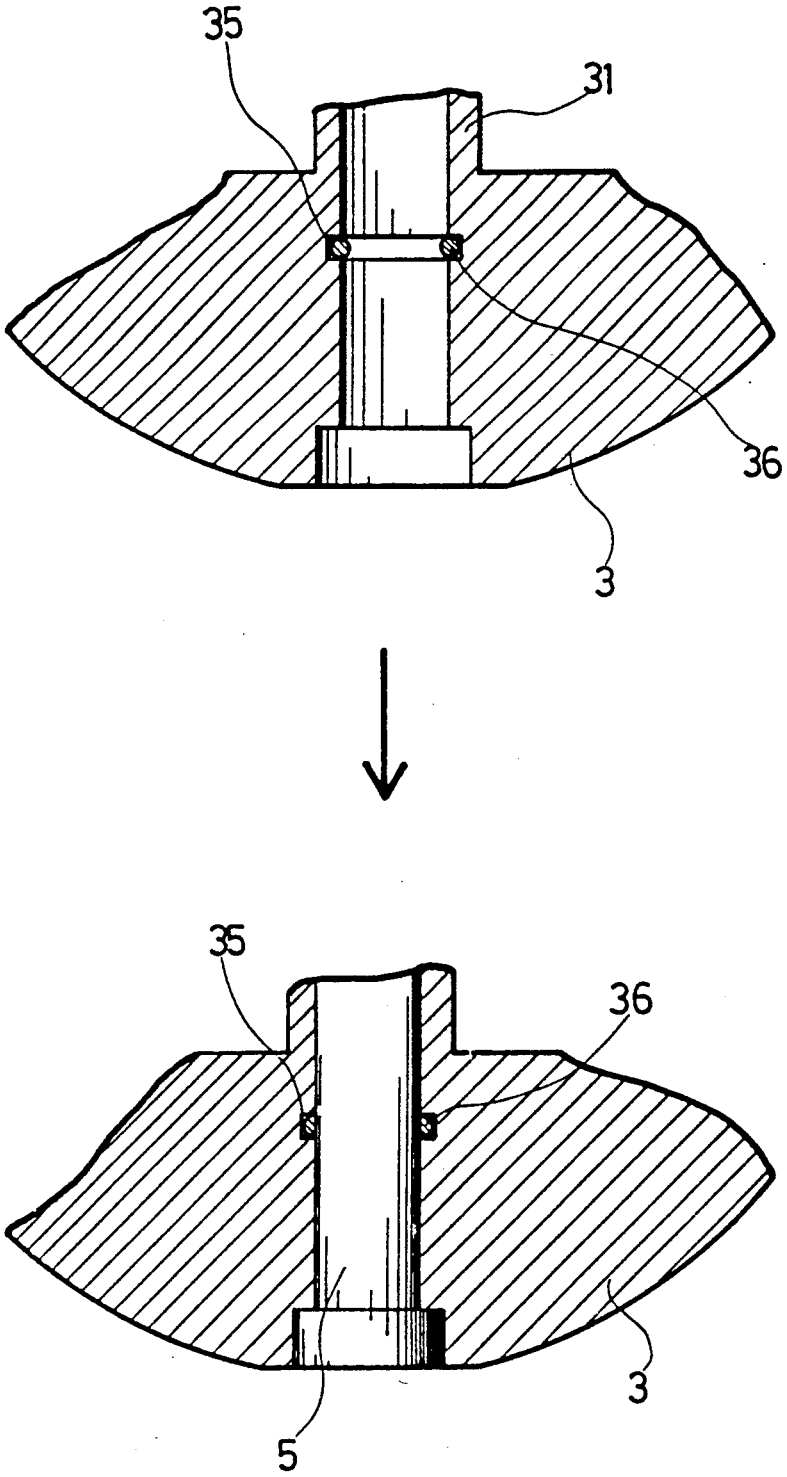
FIG. 7 is a schematic drawing illustrating the mounting of a lipstick inside the hollow shaft of the bottom unit.

Referring to FIG. 7, there is a circular groove 35 made on the inner wall surface of the hollow shaft 31 with a rubber ring 36 fixedly fastened therein. The rubber ring 36 has an inner diameter slightly smaller than the inner diameter of the hollow shaft 31 (i.e. smaller than the outer diameter of a lipstick 5). When a lipstick 5 is inserted in the hollow shaft 31 from the bottom, a friction force is produced between the rubber ring 36 and such a lipstick 5 so that a lipstick 5 can be firmly retained inside the hollow shaft 31.

I claim:

1. A spherical vanity case, comprising:

an intermediate unit having a center hole through its central axis, a plurality of compartments on its top surface for holding dusting powder and rouge cake, and a plurality of powder make-up cases at the bottom and radially arranged around a circle, said powder make-up cases having each a bottom projection;

an upper cover pivotably covered on said intermediate unit, having a mirror pivoted thereto to define therewith a receiving space for keeping eyebrow brush, eyelash pencil and other small toiletries; and a bottom unit having a hollow shaft upstanding therefrom at the center and inserted in said center hole of said intermediate unit, and a plurality of grooves spirally radially made on the top surface thereof, said hollow shaft having a top flange retained at the topmost edge of said center hole, said top flange having a plurality of notches vertically made thereon;

wherein the bottom projections of said powder make-up cases are respectively movably fastened in said grooves on said bottom unit permitting said powder make-up cases to be moved inside or out of said intermediate unit during relative rotation of said intermediate unit against said bottom unit.

2. The spherical vanity case of claim 1, wherein said powder make-up cases are respectively designed in a substantially rectangular shape having each two opposite sides made in parallel with each other and said intermediate unit has a plurality of slots radially made on its bottom and designed in size for receiving said powder make-up cases each of which permitting the bottom projection of each of said powder make-up cases to movably correspondingly fasten in one of said grooves so that said powder make-up cases can be respectively forced to radially slide in or out of said slots during the relative rotation of said intermediate unit against said bottom unit.

3. The spherical vanity case of claim 1, wherein said hollow shaft comprises a circular groove on its inner wall surface, said circular groove having a rubber ring fixedly fastened therein, said rubber ring having an inner diameter slightly smaller than the inner diameter of said hollow shaft so that a lipstick can be inserted in said hollow shaft from the bottom to be firmly retained therein by said rubber ring.

* * * * *